US005111175A

United States Patent [19]

Sugiura et al.

[11] Patent Number: 5,111,175

[45] Date of Patent: May 5, 1992

[54] RESIN MOLDING WITH EMBEDDED COIL FOR ELECTROMAGNETIC VALVE WITH THERMAL SHOCK PROTECTION OF COIL LEADS

[75] Inventors: Masayuki Sugiura, Anjo; Nobuaki Miki, Kariya; Takeshi Nasu, Anjo; Kiyohiko Sugiura, Hekinan; Masao Saito, Nishio, all of Japan

[73] Assignee: Aisin AW Co., Ltd., Japan

[21] Appl. No.: 633,619

[22] Filed: Dec. 28, 1990

[30] Foreign Application Priority Data

Dec. 28, 1989 [JP] Japan ..... 1-338191

[51] Int. Cl.[5] ..... H01H 3/00; H01H 51/34

[52] U.S. Cl. ..... 336/192; 336/96; 264/272.13; 264/272.19

[58] Field of Search ..... 336/192, 96, 90, 107; 264/272.13, 272.19

[56] References Cited

U.S. PATENT DOCUMENTS

| | | | |
|---|---|---|---|
| 3,903,223 | 9/1975 | Van Der Hoek | 336/96 |
| 4,095,206 | 6/1978 | Hishiki | 336/96 |
| 4,847,557 | 7/1989 | Saito et al. | 336/96 |
| 4,849,728 | 7/1989 | Goll et al. | 336/92 |

*Primary Examiner*—Leo P. Picard
*Assistant Examiner*—Ramon M. Barrera
*Attorney, Agent, or Firm*—Lorusso & Loud

[57] ABSTRACT

A resin molding and coil device for an electromagnetic valve for use in a vehicular hydraulic control circuit. The coil device includes a coil bobbin, an electromagnetic coil wound on the coil bobbin, leads extending from the electromagnetic coil, connection terminals connected to the leads and assembled with the coil bobbin, a molding resin covering the entire device excepting portions of the connector terminals and a thermal shock absorber, having high heat resistance, flexibility and insulating value, interposed between the leads and the molding resin. The coil device may further have grooves formed in the coil bobbin with the leads arranged therein.

7 Claims, 4 Drawing Sheets

RESIN MOLDING WITH EMBEDDED COIL FOR ELECTROMAGNETIC VALVE WITH THERMAL SHOCK PROTECTION OF COIL LEADS

BACKGROUND OF THE INVENTION

1. Field of the Invention

The present invention relates to a resin molding with an embedded coil for use in an electromagnetic valve designed for service in a hydraulic control circuit for a vehicular transmission and, more particularly, to protection of the leads of the coil device to be used in a linear solenoid.

2. Description of the Prior Art

A resin molding and coil device according to the prior art is shown in FIGS. 13 and 14. It is prepared by winding an electromagnetic coil 2 on a coil bobbin 1 and connecting a connector terminal 4 and an earth terminal 5 with the ends of the bobbin 1. Moreover, the connector terminal 4 and the earth terminal 5 have their individual fusing portions 6 connected to the leads 3 of the electromagnetic coil 2. The electromagnetic coil 2 thus wound is wrapped around its outermost circumference with an insulating tape (although not shown). The electromagnetic coil device thus assembled has its connector terminal 4 bent 90° (as indicated by dotted lines in FIG. 13). Next, the device is covered over its entire surface, excepting portions of the connector terminal 4 and the earth terminal 5, with a molding resin 7 so that the resin molding with an embedded coil is produced.

In the prior art structure described above, however, the leads 3 of the electromagnetic coil 2 and the fusing portions 6 of the connector terminal 4 and the earth terminal 5 are in direct contact with the molding resin 7. Because the leads 3 and the molding resin 7 have different coefficients of thermal expansion the device is subject to thermal shock. As a result, excessive force is received by the connections between the leads 3 and the terminals 4, which connections have low tensile strength, thus risking breakage of the leads 3.

Especially in the case of a resin molding and coil device for use in an electromagnetic valve to be mounted in a vehicle for controlling a hydraulic circuit, the molding resin 7 is exposed to high temperature and a harsh atmosphere. Hence, a need exists in the art for improvement of the protection for the leads 3 of the electromagnetic coil 2.

SUMMARY OF THE INVENTION

It is, therefore, an object of the present invention to solve the above-described problems and to provide a resin molding with embedded coil having proper protection for the leads of the coil.

In order to achieve the above-described objective according to the present invention, there is provided an improved resin molding and coil device for use in an electromagnetic valve to be mounted on a vehicle for controlling a hydraulic circuit. The improved resin molding and coil device of the present invention includes a coil bobbin, an electromagnetic coil wound on the coil bobbin, leads extending from the ends of the electromagnetic coil, connection terminals connected to the leads and a resin molding covering the entire device excepting portions of the connector terminals. A thermal shock absorber, having high heat resistance, flexibility and thermal insulating value is provided to separate the leads from the molding resin. The thermal shock absorber of the present invention has a heat insulating value significantly higher than that of the molding resin and may assume any form such as a tape or adhesive filler.

In another embodiment, the present invention provides a resin with embedded coil which includes a coil bobbin, an electromagnetic coil wound on the coil bobbin, leads extending from the ends of the electromagnetic coil, connector terminals connected to the leads and grooves formed in the coil bobbin in which the leads are arranged. Again, a molding resin covers the entire device, excepting portions of the connector terminals, and a thermal shock absorber, having high heat resistance, flexibility and insulating value, separates the leads from the molding resin.

As described above, according to the present invention, the heat-resistive, flexible and insulating thermal shock absorber is interposed between the leads of the electromagnetic coil and the molding resin so that the leads and the molding resin are not in direct contact with each other. In other words, by reason of the presence of the thermal shock absorber, the thermal shock, which might otherwise be exerted upon the leads, can be reduced to prevent breakage of the connection.

Since, moreover, the thermal shock absorber has high heat resistance, flexibility and insulating value, the coil device can be made compact while protecting the leads with reliability.

BRIEF DESCRIPTION OF THE DRAWINGS

The foregoing and other objects and features of the present invention will become apparent from the following description to be made with reference to the accompanying drawings, in which.

DESCRIPTION OF THE PREFERRED EMBODIMENTS

Several preferred embodiments of the present invention will now be described in detail with reference to the accompanying drawings.

Figure 1:
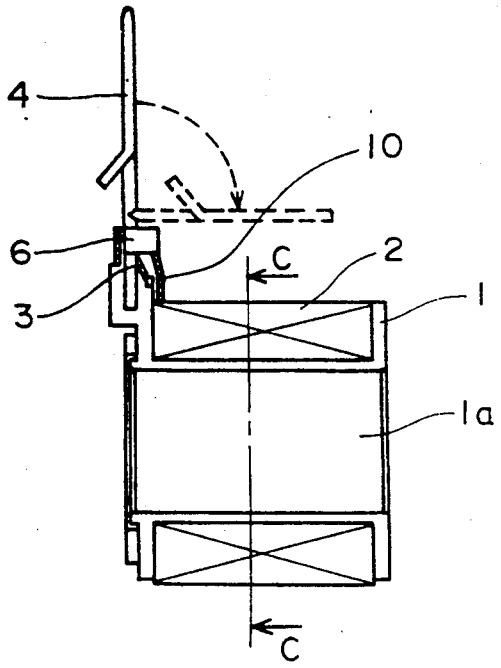
FIG. 1 is a cross-sectional view of an electromagnetic coil device according to a first embodiment of the present invention before the coil device is embedded in the resin molding.
Figure 2:
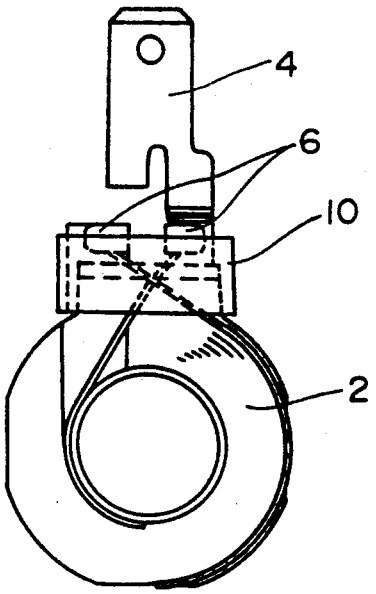
FIG. 2 is a cross-sectional view taken along arrows C—C of FIG. 1.
Figure 3:
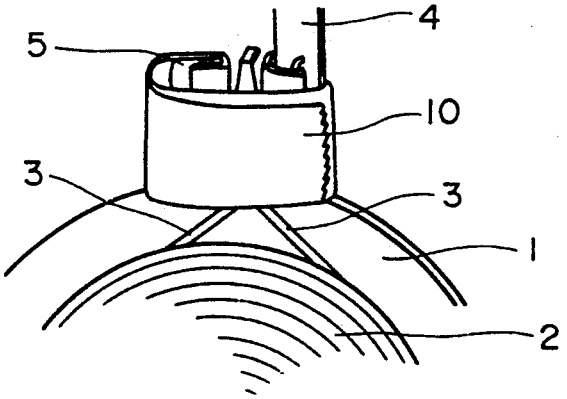
FIG. 3 is an enlarged perspective view showing the leads of the electromagnetic coil device of FIG. 1.

As shown in FIGS. 1-3, the leads 3 of an electromagnetic coil 2 wound on a coil bobbin 1 and the fusing portions 6 of a connector terminal 4 and an earth terminal 5 are wrapped with a tape 10 having high heat resistance, flexibility and insulating value. The insulating tape 10 is preferably a fluorocarbon resin such as "TEFLON."

In the electromagnetic coil device thus assembled, the connector terminal 4 is bent 90° (as indicated by dotted lines in FIG. 1). As in the prior art, the device is covered over its entire surface with a molding resin, excepting the portions of the connector terminal 4 and the earth terminal 5, so that the resin molding with embedded coil is produced.

With the structure thus far described, the tape 10 covers the leads 3 of the electromagnetic coil 2 so that leads 3 are kept away from direct contact with the molding resin. In other words, the tape 10 functions as a thermal shock absorber so that thermal shock which might otherwise be exerted upon the leads 3 from the molding resin can be reduced to prevent breakage of the connections.

Figure 4:
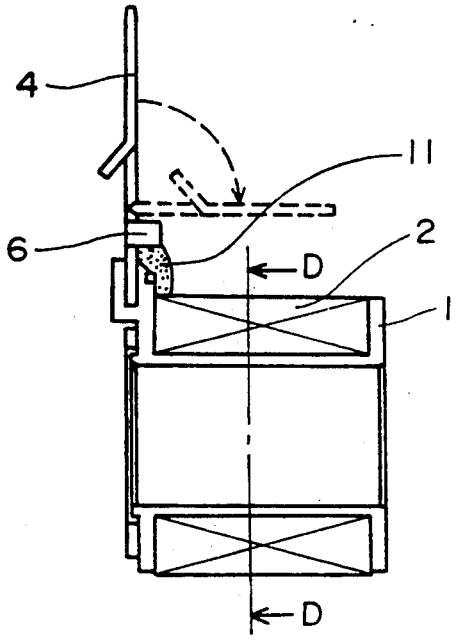
FIG. 4 is a cross-sectional view of an electromagnetic coil device according to a second embodiment of the present invention before the coil device is embedded in the resin molding.
Figure 5:
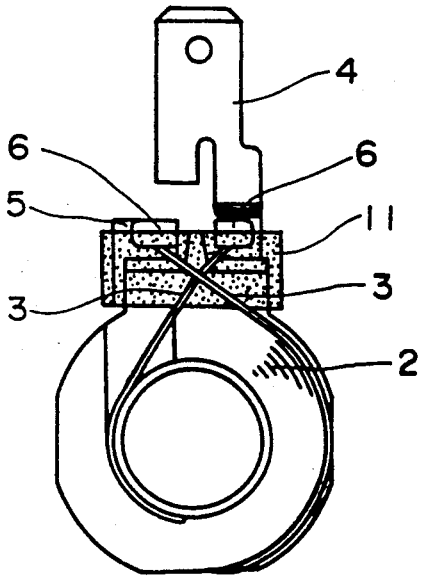
FIG. 5 is a cross-sectional view taken along arrows D—D of FIG. 4.
Figure 6:
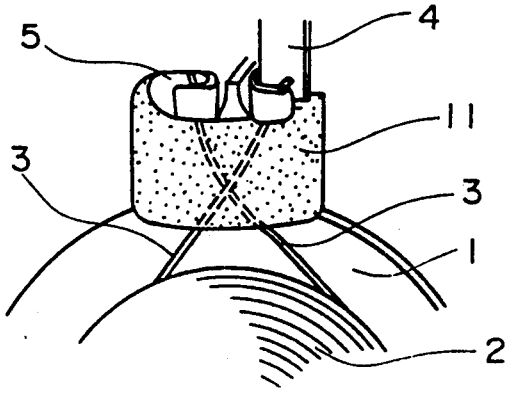
FIG. 6 is an enlarged perspective view showing the leads of the electromagnetic coil device of FIGS. 4–5.

As shown in FIGS. 4-6, an adhesive 11 acting as the thermal shock absorber is applied to both leads 3 of the electromagnetic coil 2 wound on the coil bobbin 1 and to the fusing portions 6 of the connector terminal 4 and the earth terminal 5. Here, the adhesive 11 is preferably a silicone rubber.

In the electromagnetic coil device thus assembled, the connector terminal 4 is bent 90° (as indicated by dotted lines in FIG. 4). As in the prior art, moreover, the device is covered over its entire surface excepting the portions of the connector terminal 4 and the earth terminal 5 to produce a resin molding with embedded coil in accordance with the present invention.

With the structure thus made, the adhesive 11 covers the leads 3 of the electromagnetic coil 2 so that the leads 3 can be prevented from direct contact with the molding resin. In other words, the adhesive 11 functions as the thermal shock absorber so that the thermal shocks which would otherwise be received by the leads 3 from the molding resin can be reduced to prevent breakage of the lead connections. The cushioning action is especially effective if a rubbery or elastomeric adhesive is used.

Figure 7:
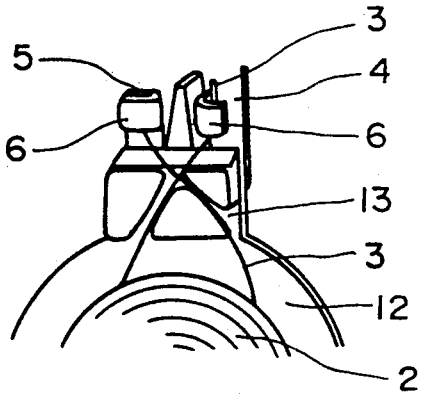
FIG. 7 is a cross-sectional view showing an electromagnetic coil device according to third embodiment of the present invention before the coil device is wrapped with a tape.
Figure 8:
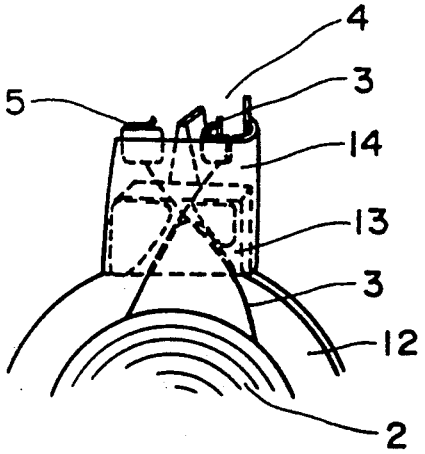
FIG. 8 is a perspective view of the electromagnetic coil of FIG. 7 having its leads wrapped with a tape.
Figure 9:
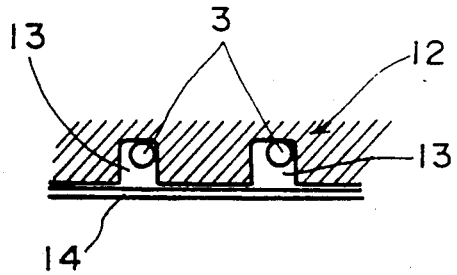
FIG. 9 is a partial sectional view showing the grooved surface of a bobbin to which the insulating tape is applied in accordance with an embodiment of the present invention.
Figure 10:
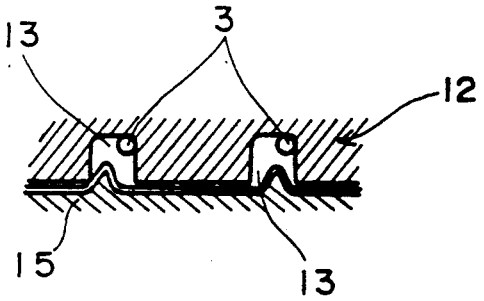
FIG. 10 is a section showing the state of the section of FIG. 9 after the molding resin has been applied.

A third embodiment is shown in FIG. 7 and includes a coil bobbin 12 formed with grooves 13 in which the leads 3 of the wound electromagnetic coil 2 are mounted. As shown in FIG. 8, the leads and the fusing portions 6 of the connector terminal 4 and the earth terminal 5 are wrapped with a tape 14 acting as the thermal shock absorber. The grooves 13 containing the leads 3 are covered with the tape 14, as shown in FIG. 9. When the resin 15 is applied to this structure, direct contact between the leads 3 and the molding resin 15 is eliminated by the interposition of the tape 14, as shown in FIG. 10, so that the aforementioned thermal shock is reduced.

Moreover, the grooves 13 may be formed in various other shapes, e.g. sloped, so long as they provide protection for the tape 14 when the tape 14 is forced into the grooves by the molding resin 15.

Figure 11:
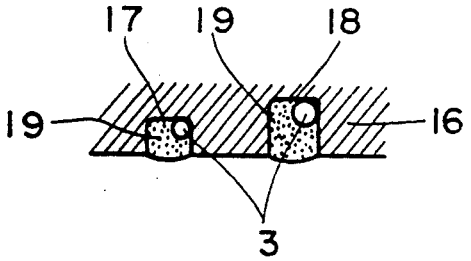
FIGS. 11 and 12 are partial sectional views showing an embodiment of the present invention wherein the coil leads are arranged in grooves on the bobbin surface with the grooves filled with a heat-insulating resin.
Figure 12:
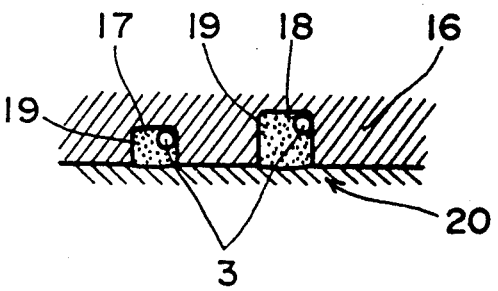
Figure 13:
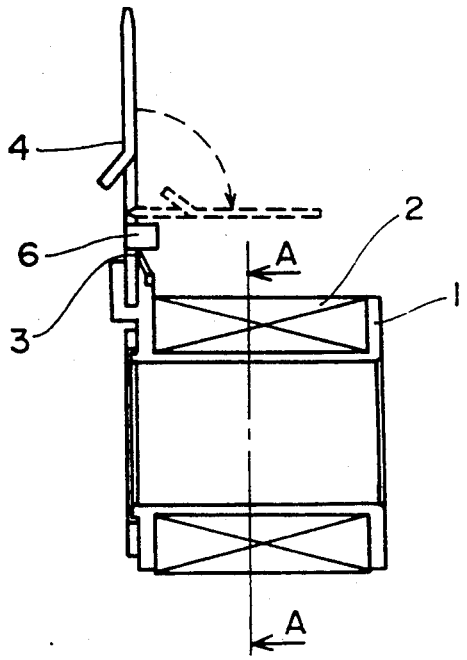
FIG. 13 is a cross-sectional view of a prior art coil device before the coil device is embedded in the resin.
Figure 14:
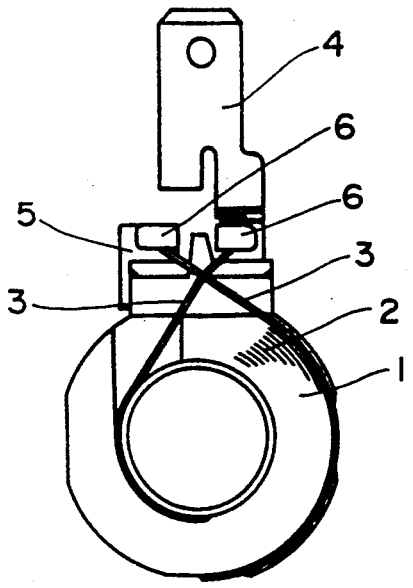
FIG. 14 is a cross-sectional view taken in the direction of arrows A—A of FIG. 13.
Figure 15:
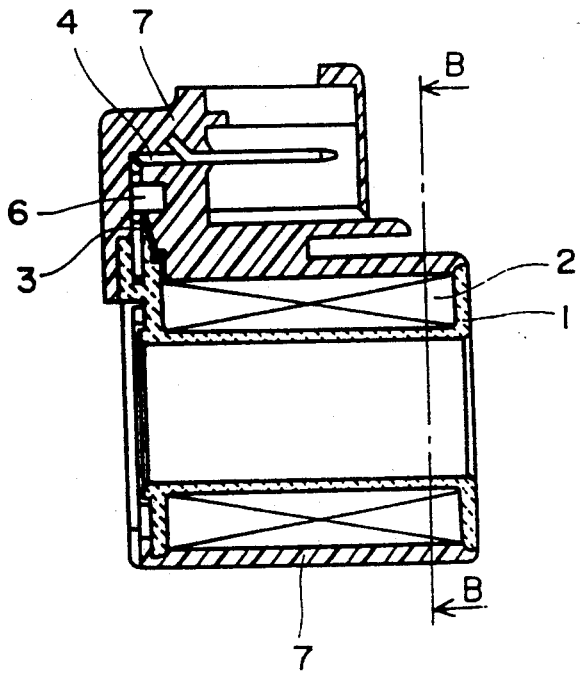
FIG. 15 is a section showing the prior art electromagnetic coil device of FIG. 13 after the resin molding step.
Figure 16:
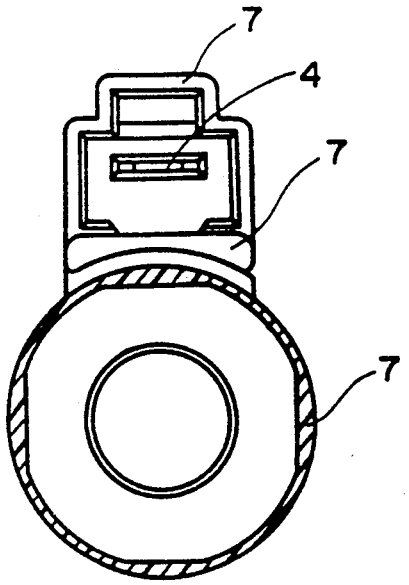
FIG. 16 is a view taken in the direction of arrows B—B of FIG. 15.

FIGS. 11 and 12 are sectional views showing tape-wrapped bobbin portions according to a fourth embodiment of the present invention. First of all, as shown in FIG. 11, the leads 3 are arranged in grooves 17 and 18 which are formed in a coil bobbin 16. Then, these grooves 17 and 18 are filled up with an adhesive 19 acting as the thermal shock absorber. If, in this case, the grooves 17 and 18 are made to have different depths, the leads 3, arranged in a crossing manner, are prevented from contact with each other at the crossing point, so that shorting can be reliably prevented. Then, the resin molding operation is carried out, but direct contact between the leads 3 and a molding resin 20 can be prevented thanks to the interposition of the adhesive 19, so that the aforementioned thermal shock is prevented.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A resin molding and coil device for an electromagnetic valve for use in a vehicular hydraulic control circuit, said device comprising:
   - a coil bobbin;
   - an electromagnetic coil wound on said coil bobbin;
   - leads extending from the ends of said electromagnetic coil;
   - connector terminals connected to said leads;
   - grooves formed in said coil bobbin and containing said leads therein;
   - a molding resin covering said bobbin, said coil, said leads and said terminals excepting portions of said terminals;
   - and a flexible heat insulator covering said grooves to separate said leads from said molding resin to reduce thermal shock to said leads and terminals.

2. A resin molding and coil device according to claim 1, wherein said flexible heat insulator is a plastic tape.

3. A resin molding and coil device according to claim 1, wherein said flexible heat insulator is an adhesive filling said groove.

4. A resin molding and coil device according to claim 1, wherein said grooves are two in number crossing each other and having different depths.

5. A resin molding and coil device according to claim 4, wherein said flexible heat insulator is a tape.

6. A resin molding and coil device according to claim 4, wherein said flexible heat insulator is an adhesive filling said grooves.

7. A resin molding and coil device for an electromagnetic valve for use in a vehicular hydraulic control circuit, said device comprising:
   - a coil bobbin;
   - an electromagnetic coil wound on said coil bobbin;

a lead extending from one end of said electromagnetic coil;

a connector terminal connected to said lead;

a groove formed in said coil bobbin and containing said lead therein;

a molding resin covering said bobbin, said coil, said lead and said terminal excepting a portion of said terminal;

and a flexible heat insulator covering said groove to separate said lead from said molding resin to reduce thermal shock to said lead and terminal.

* * * * *

UNITED STATES PATENT AND TRADEMARK OFFICE

CERTIFICATE OF CORRECTION

PATENT NO. : 5,111,175

DATED : May 5, 1992

INVENTOR(S) : SUGIURA et al

It is certified that error appears in the above-identified patent and that said Letters Patent is hereby corrected as shown below:

Col. 3, line 62, after "leads" insert --3--.

Col. 4, line 55, "groove" should read --grooves--.

Signed and Sealed this

Seventeenth Day of August, 1993

Bruce Lehman

*Attest:*

BRUCE LEHMAN

*Attesting Officer*

*Commissioner of Patents and Trademarks*